US011776471B2

(12) United States Patent
Xue

(10) Patent No.: US 11,776,471 B2
(45) Date of Patent: Oct. 3, 2023

(54) PIXEL DRIVING CIRCUIT, DRIVING METHOD THEREOF, AND DISPLAY PANEL

(71) Applicant: Shenzhen China Star Optoelectronics Semiconductor Display Technology Co., Ltd., Guangdong (CN)

(72) Inventor: Yan Xue, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 687 days.

(21) Appl. No.: 16/768,576

(22) PCT Filed: Apr. 16, 2020

(86) PCT No.: PCT/CN2020/085003
§ 371 (c)(1),
(2) Date: May 29, 2020

(87) PCT Pub. No.: WO2021/174648
PCT Pub. Date: Sep. 10, 2021

(65) Prior Publication Data

US 2023/0090375 A1 Mar. 23, 2023

(30) Foreign Application Priority Data

Mar. 5, 2020 (CN) ..... 202010146591.9

(51) Int. Cl.
*G09G 3/3233* (2016.01)

(52) U.S. Cl.
CPC ... *G09G 3/3233* (2013.01); *G09G 2300/0819* (2013.01); *G09G 2300/0852* (2013.01);
(Continued)

(58) Field of Classification Search
None
See application file for complete search history.

(56) References Cited

U.S. PATENT DOCUMENTS

2006/0033698 A1* 2/2006 Chen ..... G09G 3/3659 345/102
2014/0146028 A1 5/2014 Choi et al.
(Continued)

FOREIGN PATENT DOCUMENTS

CN 102354478 A 2/2012
CN 203376957 U * 1/2014
(Continued)

OTHER PUBLICATIONS

CN-109785800-A machine translation (Year: 2019).*

*Primary Examiner* — Dorothy Harris
(74) *Attorney, Agent, or Firm* — PV IP PC; Wei Te Chung; Zhigang Ma

(57) ABSTRACT

The invention discloses a pixel driving circuit, a driving method thereof, and a display panel. In the present invention, by adding a single-stage compensation circuit of the second data input module to the first data input module, the driving transistor is controlled by the potential generated at the first node when the first data signal and the second data signal are coupled to the first node, and the power signal is transmitted to the second node to make the light emitting element emit light, which can reduce dynamic power consumption and improve the display performance of the display panel.

9 Claims, 5 Drawing Sheets

(52) U.S. Cl.
CPC ... *G09G 2310/08* (2013.01); *G09G 2330/021* (2013.01); *G09G 2330/04* (2013.01)

(56) References Cited

U.S. PATENT DOCUMENTS

| | | | | |
|---|---|---|---|---|
| 2015/0130780 | A1* | 5/2015 | Kwon | G09G 3/3233 345/82 |
| 2015/0364074 | A1 | 12/2015 | Li et al. | |
| 2016/0203756 | A1 | 7/2016 | Kawabe | |
| 2019/0156748 | A1* | 5/2019 | Jin | G09G 3/3258 |
| 2021/0313355 | A1* | 10/2021 | Yamazaki | H10K 59/86 |
| 2022/0051629 | A1* | 2/2022 | Jeong | G09G 3/3233 |
| 2022/0139322 | A1* | 5/2022 | Wang | G09G 3/2081 345/690 |

FOREIGN PATENT DOCUMENTS

| | | | | | |
|---|---|---|---|---|---|
| CN | 107705755 | A | | 2/2018 | |
| CN | 109658868 | A | | 4/2019 | |
| CN | 109785800 | A | * | 5/2019 | |
| CN | 109785800 | A | | 5/2019 | |
| CN | 110021265 | A | * | 7/2019 | G09G 3/32 |
| CN | 110021265 | A | | 7/2019 | |
| WO | 2009117092 | A1 | | 9/2009 | |
| WO | 2020039291 | A1 | | 2/2020 | |

* cited by examiner

PIXEL DRIVING CIRCUIT, DRIVING METHOD THEREOF, AND DISPLAY PANEL

BACKGROUND OF INVENTION

Field of Invention

The present invention relates to the field of display field, and particularly, to a pixel driving circuit, a driving method thereof, and a display panel.

Description of Prior Art

Up to now, current iterations of display panels have been rapidly updated, comprising a light emitting diode (LED) display panel, a mini-light emitting diode (Mini-LED) display panel, and a organic light-emitting diode (OLED) display panel, and active matrix organic light-emitting diode (AMOLED). All kinds of display panels need to drive the light-emitting diode in the display panel to emit light through a pixel driving circuit to display image.

The general pixel driving circuit uses a 2T1C pixel driving circuit structure as shown in FIG. 1. It can be known from FIG. 1 that the conventional pixel driving circuit with a 2T1C structure comprises a transistor T1, a transistor T2, a storage capacitor C, a light emitting element D, a power signal line, a low-level signal line, a scanning signal line, and a data signal line; among them, a gate G1 of the transistor T1 is connected to a first pole of the transistor T2, a first pole of the transistor T1 is connected to the power signal line VDD, a second pole of the transistor T1 is connected to the anode of the light emitting element D; the cathode of the light emitting element is grounded VSS; a gate G1 of the transistor T2 is connected to the scanning signal line, the second pole of transistor T2 is connected to the data signal line; one end of storage capacitor C is connected to a first node G, and the first node G is connected to the gate of the transistor T1 and the first pole of the transistor T2, the other end of the storage capacitor C is connected to the second node S, and the second node S is connected to the second pole of the transistor T1 and a low-level signal.

The light-emitting element D is turned on and off by the driving method of the pixel driving circuit of the display panel. Referring to FIG. 2, FIG. 2 is a first timing chart of the driving method of the pixel driving circuit of FIG. 1. The driving method comprises:

The data signal is provided through the data signal line, the scan signal is provided through the scan signal line, the low level signal is provided through the low level signal line, and the power signal is provided through the power signal line. During the display period of one frame of image, when the scan signal line provides a high-level scanning signa and the data signal line provides a high-level data signal, the transistor T2 is turned on, the first node G obtains the first high potential Vg, and then the transistor T1 is turned on. Because the storage capacitor stores a part of the voltage, therefore the second node S obtains a second high potential Vs lower than the first high potential, and the light emitting element is caused by a current $I_{OLED}$ generated by a voltage difference between the second high potential Vs of the second node S and the low potential VSS of the low level line. Luminescence, the second highest potential Vs. When the 2T1C pixel circuit is driving AMOLED, the dynamic power consumption I of the data signal line can be obtained by the following formula (1):

$$I=fcV_{data}^2 \quad (1)$$

Among them, I is the dynamic power consumption of the data signal line, f is the display frequency of the image, c is the capacitance, and $V_{data}$ is the voltage of the data signal line.

However, in a conventional pixel driving circuit of the display panel, a large current is required to drive the light-emitting element D to emit light, for example, the current of the light-emitting element D is 1.5 μA. Therefore, the high-level voltage of the data signal line needs to output a relatively high voltage. A high voltage Vdata can provide sufficient current to the light-emitting element D to cause it to emit light, for example, $V_{data}$=15V. According to the calculation formula of the dynamic power consumption I, it can be seen that the dynamic power consumption of the display panel is large, and it is easy to cause the temperature of the related components of the display panel to increase greatly, and the device characteristics are liable to change, so that the display screen appears abnormal, which affects the display performance and practicality of the display panel.

SUMMARY OF INVENTION

Due to the large dynamic power consumption of the display panel, the display screen appears abnormal, which affects the display performance and practicality of the display panel.

The present invention provides a pixel driving circuit, comprising: a first data input module, a second data input module, a display driving module and a light emitting module;

the first data input module is configured to couple a first data signal to a first node;

the second data input module is configured to couple a second data signal to the first node;

the display driving module comprises a driving transistor, and the driving transistor is controlled by a potential generated at the first node when the first data signal and the second data signal are coupled to the first node, and is used to transmit a power signal to the second nod;

the light emitting module comprises a light emitting element, and an anode of the light emitting element is connected to the second node, and a cathode of the light emitting element is grounded, and the light emitting module is configured to generate a working current under the control of the power signal coupled to the second node and emit light according to the working current.

The present invention also provides a driving method of a pixel driving circuit, comprising:

providing a pixel driving circuit, the pixel driving circuit comprises a first data input module, a second data input module, a display driving module and a light emitting module;

the display driving module comprises a driving transistor, and the driving transistor is controlled by a potential generated at the first node when the first data signal and the second data signal are coupled to the first node;

the light emitting module comprises a light emitting element, and an anode of the light emitting element is connected to the second node, and a cathode of the light emitting element is grounded;

the driving method comprises within a display period of a frame image:

the first data input module couples the first data signal to the first node;

the second data input module couples the second data signal to the first node; the display driving module transmits the power signal to the second node;

the light emitting module generates a working current under the control of the power signal coupled to the second node and emit light according to the working current.

The present invention also provides a display panel, comprising a pixel driving circuit, wherein the pixel driving circuit comprises a first data input module, a second data input module, a display driving module and a light emitting module;

the first data input module is configured to couple a first data signal to a first node;

the second data input module is configured to couple a second data signal to the first node;

the display driving module comprises a driving transistor, and the driving transistor is controlled by a potential generated at the first node when the first data signal and the second data signal are coupled to the first node, and is used to transmit a power signal to the second nod;

the light emitting module comprises a light emitting element, and an anode of the light emitting element is connected to the second node, and a cathode of the light emitting element is grounded, and the light emitting module is configured to generate a working current under the control of the power signal coupled to the second node and emit light according to the working current.

After the first data signal is coupled to the first node by the first data input module, the second data input module couples the second data signal to the second node, so that the voltage of the second node becomes the superposition of the voltage of the first data signal and the voltage of the second data signal, and since the voltage is greater than the voltage between the gate and the source of the driving transistor, the driving transistor is turned on, and the power signal is coupled to the second node. The voltage of the second node is positively related to the voltage of the first node and the high-level voltage transmitted after the driving transistor is turned on. The light-emitting element in the light-emitting module generates a control current under the control of the power signal of the second node to cause the light-emitting element to emit light. The low voltage of each data signal is superimposed to a voltage sufficient to cause the light-emitting element to emit light, which can greatly reduce the data voltage of the display panel, thereby reducing dynamic power consumption, and ultimately reducing the total power consumption and improving the display performance of the display panel.

DETAILED DESCRIPTION OF PREFERRED EMBODIMENTS

The primary object of the present invention is: by adding a single-stage compensation circuit of the second data input module to the first data input module, the driving transistor is controlled by the potential generated at the first node when the first data signal and the second data signal are coupled to the first node, and the power signal is transmitted to the second node to make the light emitting element emit light, which can reduce dynamic power consumption and improve the display performance of the display panel.

The technical solutions of the various exemplary embodiments provided by the present invention will be clearly and completely described below with reference to the accompanying drawings in the embodiments of the present invention. In the case of no conflict, the following embodiments and their technical features can be combined with each other.

Figure 1:
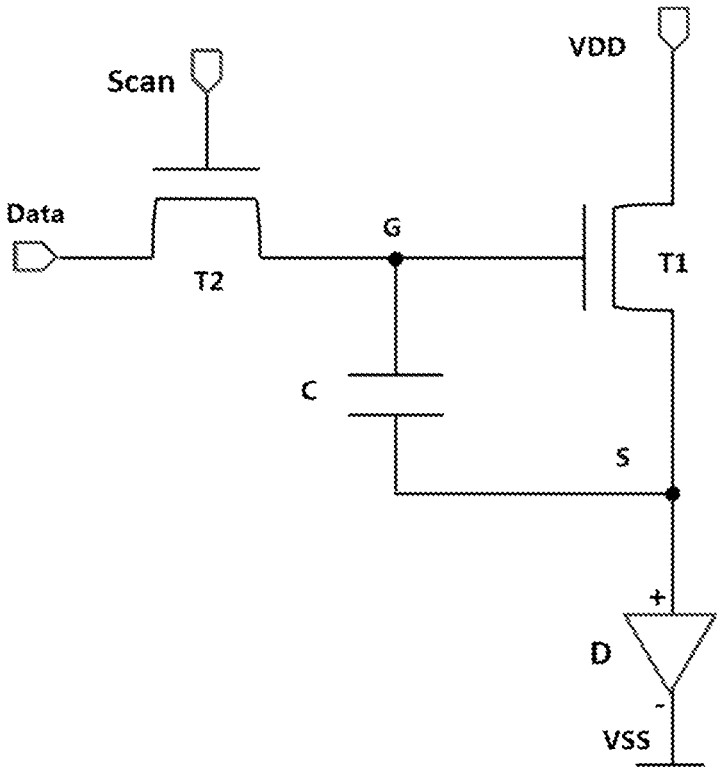
FIG. 1 (Prior Art)
FIG. 1 is an equivalent schematic diagram of a conventional 2T1C pixel driving circuit.
Figure 2:
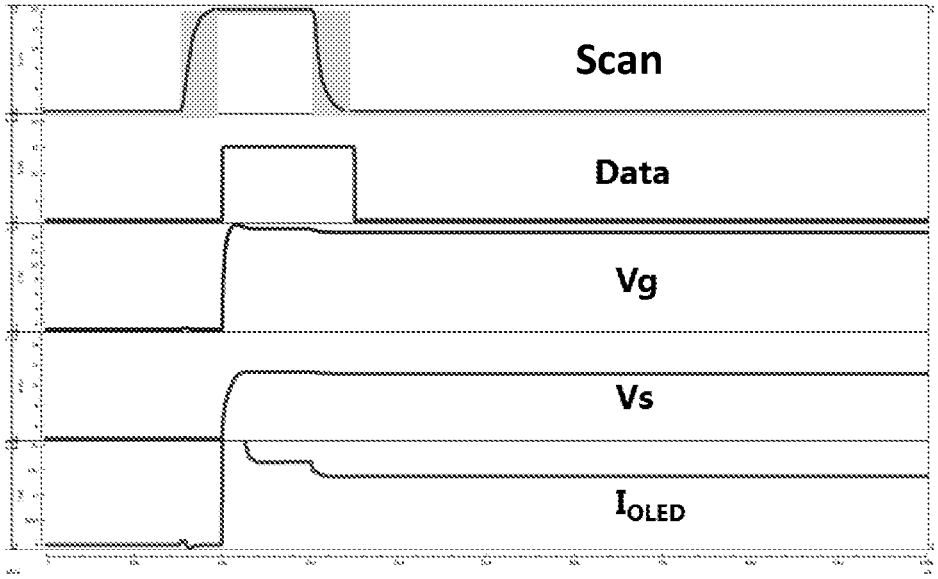
FIG. 2 (Prior Art)
FIG. 2 is a first timing diagram of a driving method of a conventional 2T1C pixel driving circuit.
Figure 3:
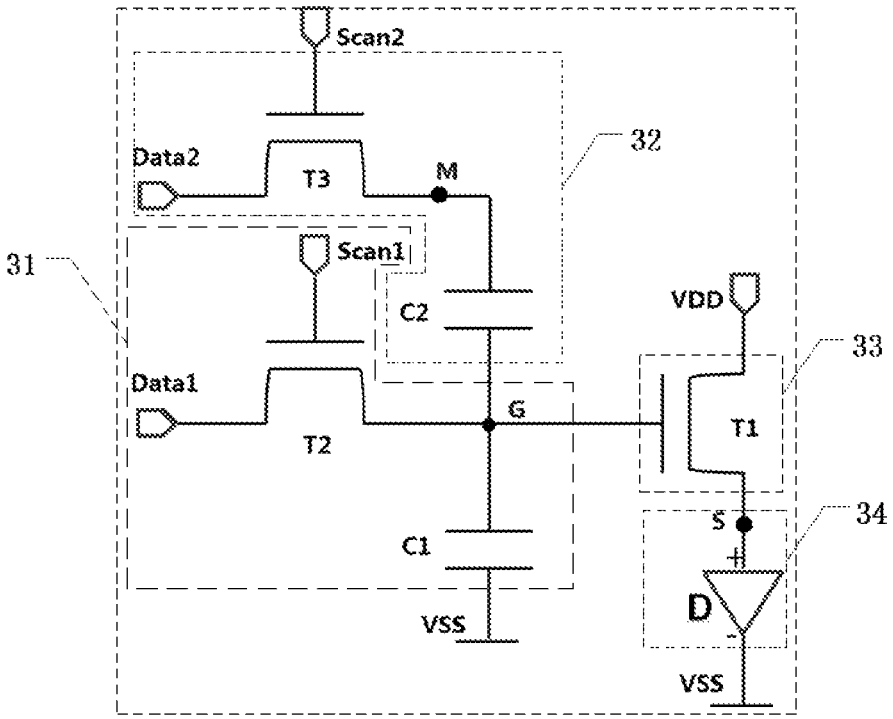
FIG. 3 is an equivalent schematic diagram of a pixel driving circuit in an embodiment of the present invention.

Please refer to FIG. 3. FIG. 3 is an equivalent schematic diagram of a pixel driving circuit according to an embodiment of the present invention.

An embodiment of the present invention provides a pixel driving circuit for driving a display panel to emit light. The pixel driving circuit comprises a first data input module 31, a second data input module 32, a display driving module 33, and a light emitting module 34;

the first data input module 31 is configured to couple a first data signal Data1 to a first node G;

the second data input module 32 is configured to couple a second data signal Data2 to the first node G;

the display driving module 33 comprises a driving transistor T1, and the driving transistor is controlled by a potential generated at the first node when the first data signal and the second data signal are coupled to the first node, and is used to transmit a power signal to the second nod;

the light-emitting module 334 comprises a light-emitting element D, and an anode of the light-emitting element D is connected to the second node S, and a cathode of the light-emitting element D is grounded, and the light emitting module is configured to generate a working current under the control of the power signal coupled to the second node and emit light according to the working current.

It should be noted that the driving transistor T1 in the embodiment of the present invention may be a P-type transistor or an N-type transistor, which is not limited herein.

It should be noted that the driving transistor T1 in the embodiment of the present invention may be a metal-oxide-semiconductor field-effect transistor (MOS transistor) or a thin film transistor (TFT), which is not limited herein.

Further, in the case that the driving transistor T1 in the embodiment of the present invention is a thin film transistor, the thin film transistor may be an amorphous silicon thin film transistor or a low temperature polysilicon thin film transistor, which is not limited herein.

It should be noted that the light-emitting element in the embodiment of the present invention may be a light-emitting diode LED, or a mini-LED, an organic light-emitting diode OLED, or an active-matrix organic light-emitting diode AMOLED, which is not limited herein.

The pixel driving in the embodiments of the present invention, after the first data signal Data1 is coupled to the first node G by the first data input module 31, the second data input module 32 couples the second data signal Data2 to the second node S, so that the voltage of the second node S becomes the superposition of the voltage of the first data signal Data1 and the voltage of the second data signal Data2, and since the voltage is greater than the voltage between the gate and the source of the driving transistor T1, the driving transistor T1 is turned on, and the power signal is coupled to the second node S. The voltage of the second node S is positively related to the voltage of the first node G and the high-level voltage transmitted after the driving transistor T1 is turned on. The light-emitting element D in the light-emitting module generates a control current under the control of the power signal of the second node S to cause the light-emitting element to emit light. The low voltage of each data signal is superimposed to a voltage sufficient to cause the light-emitting element to emit light, which can greatly reduce the data voltage of the display panel, thereby reducing dynamic power consumption, and ultimately reducing the total power consumption and improving the display performance of the display pane.

The specific solutions for implementing the above embodiments of the present invention are the following two embodiments:

Preferably, referring to FIG. 3, a specific solution for implementing a pixel driving circuit in the embodiment of the present invention is:

As mentioned above, the pixel driving circuit comprises a first data input module 31, a second data input module 32, a display driving module 33, and a light emitting module 34;

the first data input module 31 comprises:

a first transistor T2, a first pole of the first transistor T2 is connected to the first node G, a second pole of the first transistor T2 is connected to the first data signal Data1, and a gate G2 of the first transistor T2 is connected to a first scan signal Scan1;

a first storage capacitor C1, one end of the first storage capacitor C1 is connected to the first node G, and the other end of the first storage capacitor C1 is connected to the second node S.

In addition, the first pole of the driving transistor T1 in the display driving module 33 is connected to the power signal VDD, the second pole of the driving transistor T1 is connected to the second node S, and the gate of the driving transistor T1 is connected to the first node G.

It should be noted that the first data signal Data1 in the embodiment of the present invention may be provided by a first data signal line, the first scan signal Scan1 may be provided by a first scan signal line, and the second data signal Data2 may be provided by a second data signal Line, the second scan signal Scant may be provided by the second scan signal line.

It should be noted that the driving transistor T1, the first transistor T2, and the second transistor T3 in the embodiment of the present invention may be all N-type transistors or all P-type transistors.

Further, when the transistors in this embodiment are all N-type, the first pole of the driving transistor T1, the first pole of the first transistor T2, and the first pole of the second transistor T3 are all drains, and the second pole of the driving transistor T1, the second pole of the second transistor T2, and the second electrode of the second transistor T3 are all sources. Conversely, when the transistors in this embodiment are all P-type, the first pole of the driving transistor T1, the first pole of the first transistor T2, and the first pole of the second transistor T3 are all sources, and the second pole of the driving transistor T1, the second pole of the second transistor T2, and the second electrode of the second transistor T3 are all drains.

In this embodiment, an N-type transistor is taken as an example to describe a pixel driving circuit and a driving method thereof.

Figure 4:
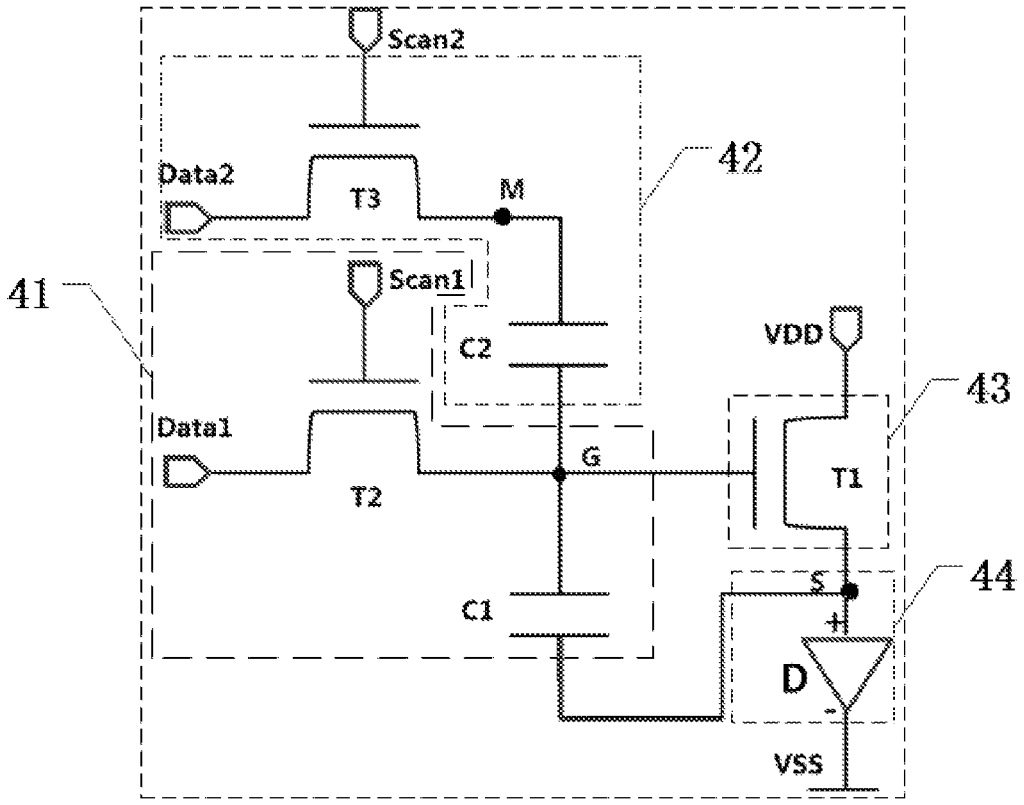
FIG. 4 is an equivalent schematic diagram of another pixel driving circuit in the embodiment of the present invention.

The above is a specific scheme for realizing a pixel driving circuit in the embodiment of the present invention. Referring to FIG. 4, FIG. 4 is an equivalent schematic diagram of another pixel driving circuit in the embodiment of the present invention.

A specific solution of another pixel driving circuit provided in the embodiment of the present invention is:

the pixel driving circuit comprises a first data input module 41, a second data input module 42, a display driving module 43 and a light emitting module 44;

the first data input module 41 comprises:

the first transistor T2, the first pole of the first transistor T2 is connected to the first node G, the second pole of the first transistor T2 is connected to the first data signal Data1, and the gate G2 of the first transistor T2 is connected to the first scan signal Scan1;

the first storage capacitor C1, one end of the first storage capacitor C1 is connected to the first node G, and the other end of the first storage capacitor C1 is grounded to VSS.

the structure of the second data input module 42 is similar to the structure of the second data input module 32 in the aforementioned pixel driving circuit, and details are not described herein again.

The structure of the second data input module 42 is similar to the structure of the second data input module 32 in the aforementioned pixel driving circuit, and details are not described herein again.

The structure of the display driving module 43 is similar to that of the display driving module 42 in the aforementioned pixel driving circuit, and is not repeated here.

Figure 5:
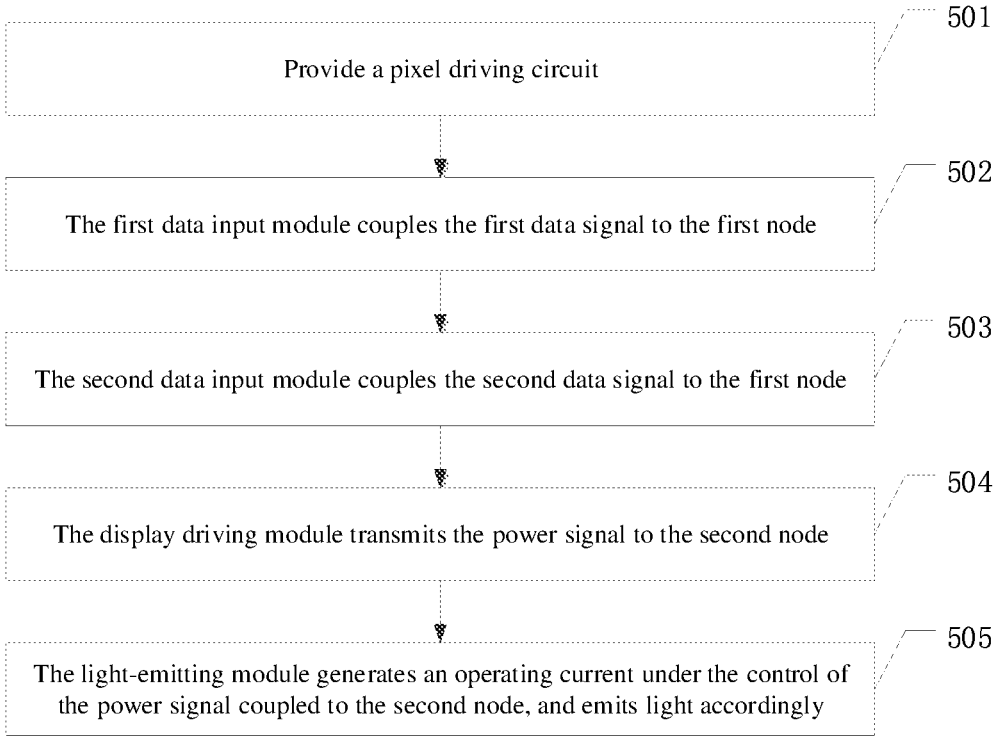
FIG. 5 is a schematic flowchart of a driving method of a pixel driving circuit according to an embodiment of the present invention.
Figure 6:
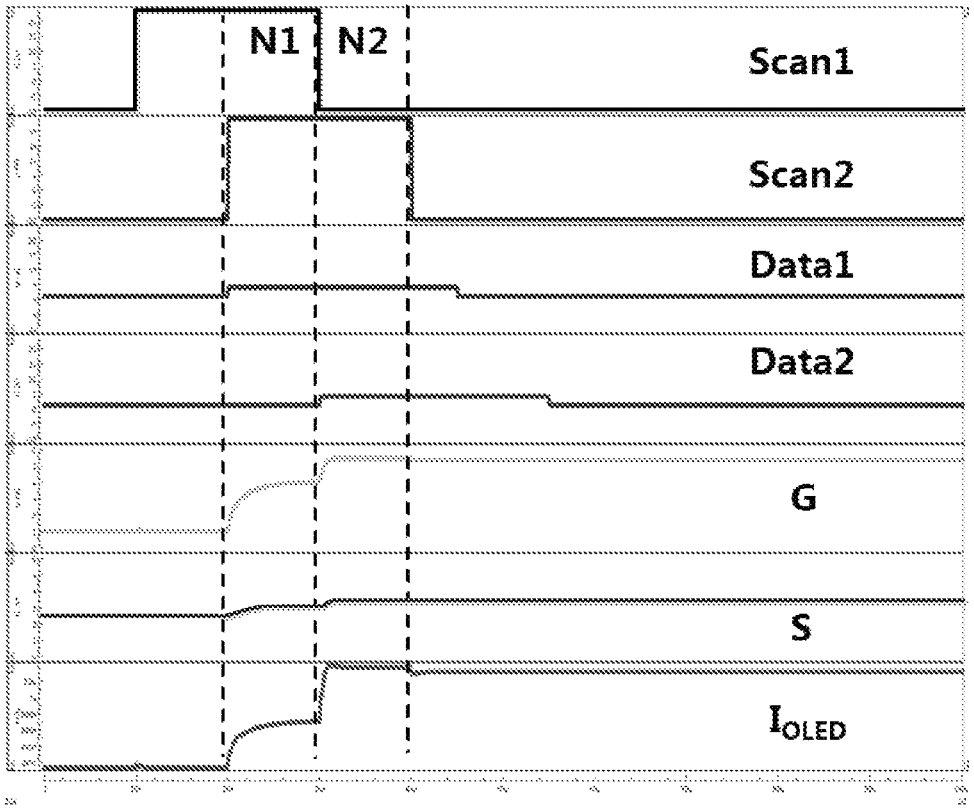
FIG. 6 is a second timing diagram of a driving method of a pixel driving circuit according to an embodiment of the present invention.

Based on the above pixel driving circuit, an embodiment of the present invention also provides a pixel driving method. Please refer to FIG. 5 and FIG. 6. FIG. 5 is a schematic flowchart of a driving method of a pixel driving circuit according to an embodiment of the present invention. FIG. 6 is a second timing diagram of a driving method of a pixel driving circuit according to an embodiment of the present invention.

In the embodiment of the present invention, the driving method based on the pixel driving circuit of FIG. 3 and FIG. 4 comprises the following steps in a frame display period:

S501. Provide a pixel driving circuit;

For details, please refer to the embodiments described in FIG. 3 and FIG. 4.

S502. The first data input module 31 couples the first data signal Data1 to the first node G.

S503. The second data input module 32 couples the second data signal Data2 to the first node G.

S504. The display driving module 33 transmits the power signal VSS to the second node S.

S505. The light-emitting module 34 generates an operating current under the control of the power signal VDD coupled to the second node S, and emits light accordingly.

The driving method of the pixel driving circuit in embodiments of the present invention, because the input voltage of the first data signal is compensated, the superposition of the voltage of the first data signal and the voltage of the second data signal is obtained, so that the light-emitting element can obtain a sufficient current to emit light. The respective low voltages of the signals are superimposed to a voltage sufficient to cause the light-emitting elements to emit light, which can greatly reduce the data voltage of the display panel, thereby reducing dynamic power consumption, and ultimately reducing the total power consumption and improving the display performance of the display panel.

Referring to FIG. 6 and Table 1, the driving method based on the pixel driving circuit in the foregoing pixel driving circuit in FIG. 3 will be described.

Table 1 shows the amplitude of the voltage transmitted by each signal line.

TABLE 1

| signal | voltage amplitude minimum value (V) | Max value (V) |
|---|---|---|
| Scan1 | −10 | +20 |
| Scan2 | −10 | +20 |
| Data1 | 1 | 5 |
| Data2 | 1 | 5 |
| VDD | +24 | |
| VSS | 0 | |

In the embodiment of the present invention, the high-level first data signal Data1 or the low-level first data signal Data1 may be provided through the first data signal line, and the high-level first scan signal Scan1 or low may be provided through the first scanning signal line. The first scan signal Scan1 with a high potential may provide a second data signal Data1 with a high potential or the second data signal Data1 with a low potential through a second data signal line, and the second scan signal Scan1 with a high potential may be provided through a second scan signal line. Or the low-level second scan signal Scan1.

Specifically, before the first preset duration N1, the first transistor T2 is connected to the first high potential 5V of the first scan signal Scan1, and the first transistor T2 is turned on. Within the first preset duration N1, the first data signal Data1 is coupled to the first node G. At this time, the voltage of the first node G rises to the first threshold voltage VG1. Because the first threshold voltage VG1 is greater than the threshold voltage between the gate and the source of the driving transistor T1, the driving transistor T1 is turned on, the power signal VDD is coupled to the second node S, and the voltage of the second node rises to the second threshold voltage VS1 The current IOLED of the light-emitting element D rises slightly, and rises to the first threshold current IOLED1.

It should be noted that, in the embodiment of the present invention, the second threshold voltage at the second node S is not only positively related to the voltage of the power signal, but also positively related to the first threshold voltage at the first node G.

It should be noted that, in the embodiment of the present invention, the first scan signal before the preset duration N1 and the high potential within the preset duration N1, and the first data signal with the high potential within the preset duration N1 refer to pulse signals.

Then, within the second preset time period N2, the first scan signal Scan1 is at a low potential and the second scan signal Scant is at a high potential, so the first transistor T2 is turned off and the second transistor T3 is turned on. At this time, the second data signal Data15V Coupled to the third node M, the voltage of the third node M can be changed from 1V to 5V, and then coupled to the first node G through the second storage capacitor C2, so the voltage of the first node G rises from the first threshold voltage $V_{G1}$ to the third node M. Three threshold voltages $V_{G3}$. In theory, the increase in the voltage at the first node G, that is, the difference between the third threshold voltage $V_{G3}$ and the first threshold voltage $V_{G1}$, can be obtained from the following formula (2):

$$V_{G13}=4V*C2/(C1+C2) \quad (2)$$

That is, the third threshold voltage of the first node G can be obtained by the following formula (3):

$$V_{G3}=5+4C2/(C1+C2) \quad (3)$$

At this time, the driving transistor T1 continues to be turned on, the voltage of the second node S rises from the second threshold voltage $V_{S2}$ to the fourth threshold voltage $V_{S4}$, and the current emitted by the light emitting element D rises to the second threshold current $I_{OLED1}$1.5 uA, so the light emitting element D glows.

It should be noted that the fourth threshold voltage at the second node S is not only positively related to the voltage of the power supply signal, but also positively related to the third threshold voltage at the first node G.

According to the foregoing formula (1), it can be known that the dynamic power consumption I of the first data signal line and the second data signal line is positively related to the image display frequency, capacitance, voltage of the first data signal line, and voltage of the second data signal line. Because the voltage of the first data signal is greatly reduced in the embodiment of the present invention, the voltage of the second data signal is also much lower than the voltage of the data signal of the existing 2T1C pixel driving circuit, and the storage capacitor C1 and the storage capacitor C2 are connected in series so that The total storage capacitance is reduced compared to the storage capacitance in the existing 2T1C pixel driving circuit, so the dynamic power consumption I of the total data signal line is greatly reduced.

In the embodiment of the present invention, if the pixel driving circuit structure shown in FIG. 4 is adopted, the driving method is similar to the driving method described above, except that the first storage capacitor C1 is not connected to the ground, but is connected to the second node S. When the voltage of a node G reaches the first threshold voltage $V_{G1}$, since a part of the voltage is coupled to the second node S through the first storage capacitor C1, the voltage at which the driving transistor T1 is turned on will be reduced, so it is possible As a result, the driving transistor T1 cannot be turned on, and it can be turned on only after the voltage of the first node G reaches the third threshold voltage $V_{G3}$. Therefore, the current at the second node S may rise very quickly, which is not conducive to protecting the light-emitting element D. Normal glow. However, the driving method of this embodiment is also an optional solution in the present invention, and the driving method in FIG. 3 is the most preferred solution.

In the driving method of the pixel driving circuit in this embodiment, the voltage of the first data signal and the voltage of the second data signal are obtained at the first node G by compensating the first threshold voltage $V_{G1}$ of the input first data signal The third threshold voltage $V_{G3}$ is superimposed, so that the voltage of the second node S is increased from the second threshold voltage $V_{S2}$ to $V_{S1}$, so that the current $I_{OLED}$ of the light-emitting element D is increased from $I_{OLED1}$ to $I_{OLED2}$ and a sufficient current is obtained to emit light. It protects the light-emitting element D from being burnt out due to the sudden rise of current so that it cannot emit light normally, and because the low voltage of the two data signals is superimposed to a voltage sufficient to cause the light-emitting element to emit light, the display panel can be greatly reduced. The data voltage can reduce the dynamic power consumption, and finally achieve the purpose of reducing the total power consumption, and improve the display performance of the display panel.

An embodiment of the present invention also provides a display panel. The display panel adopts the pixel driving circuit structure in the embodiment of the present invention, which can greatly reduce the data voltage of the display panel, thereby reducing dynamic power consumption, and finally reducing the total power consumption. The purpose is to improve the display performance of the display panel.

Although the present invention has been shown and described with respect to one or more implementations, those skilled in the art will recognize equivalent variations and modifications upon reading and understanding the present specification and drawings. The invention includes all such modifications and alterations and is limited only by the scope of the following claims. In particular with regard to the various functions performed by the aforementioned components, the terminology used to describe such components is intended to correspond to any component (unless otherwise indicated) that performs the specified function of the component (eg, it is functionally equivalent) Even if it is not structurally equivalent to the disclosed structure that performs the functions in the exemplary implementation of the present specification shown herein. Furthermore, although a particular feature of this specification has been disclosed with respect to only one of several implementations, this feature may be compared to one or more of other implementations as may be desirable and advantageous for a given or specific application. Other feature combinations. Moreover, to the extent that the terms "including," "having," "containing," or variations thereof are used in the detailed description or claims, such terms are intended to be included in a manner similar to the term "comprising." Further, it should be understood that the "plurality" mentioned herein refers to two or more. For the steps mentioned in this article, the suffixes are only for the purpose of clearly expressing the embodiments and are easy to understand. They do not completely represent the order in which the steps are performed, and the logical relationship should be set as the thinking.

The above description is only an embodiment of the present invention, and therefore does not limit the scope of the patent of the present invention. Any equivalent structure or equivalent process transformation made using the description of the present invention and the contents of the drawings, such as the mutual interaction of technical features between the embodiments Combined, or used directly or indirectly in other related technical fields, are equally included in the scope of patent protection of the present invention.

What is claimed is:

1. A pixel driving circuit, comprising: a first data input module, a second data input module, a display driving module, and a light emitting module; wherein, the first data input module is configured to couple a first data signal to a first node;

the second data input module is configured to couple a second data signal to the first node after the first data signal is coupled to the first node by the first data input module, so that a voltage at the first node becomes superposition of a voltage of the first data signal and a voltage of the second data signal;

the display driving module comprises a driving transistor, and the driving transistor is controlled by a potential generated at the first node when the first data signal and the second data signal are coupled to the first node, and is used to transmit a power signal to a second node;

the light emitting module comprises a light emitting element, and an anode of the light emitting element is connected to the second node, and a cathode of the light emitting element is grounded, and the light emitting module is configured to generate a working current under the control of the power signal coupled to the second node and emit light according to the working current;

the first data input module comprises a first transistor and a first storage capacitor; a first pole of the first transistor is connected to the first node, a second pole of the first transistor is connected to the first data signal, and a gate of the first transistor is connected to a first scan signal; a first storage capacitor, one end of the first storage capacitor is connected to the first node, and another end of the first storage capacitor is directly grounded; and the second data input module comprises a second transistor and a second storage capacitor, a first pole of the second transistor is connected to a third node, a second pole of the second transistor is connected to the second data signal, and a gate of the second transistor is connected to a second scan signal; one end of the second storage capacitor is connected to the third node, and the other end of the second storage capacitor is connected to the first node.

2. The pixel driving circuit of claim 1, wherein the driving transistor, the first transistor, and the second transistor are all N-type transistors, or the driving transistor, the first transistor, and the second transistor are all P-type transistors.

3. The pixel driving circuit of claim 1, wherein a first pole of the driving transistor is connected to the power signal, a second pole of the driving transistor is connected to the second node, and a gate of the driving transistor is connected to the first node.

4. A driving method of a pixel driving circuit, comprising:

providing a pixel driving circuit, wherein the pixel driving circuit comprises a first data input module, a second data input module, a display driving module, and a light emitting module;

the display driving module comprises a driving transistor, and the driving transistor is controlled by a potential generated at the first node when the first data signal and the second data signal are coupled to the first node;

the light emitting module comprises a light emitting element, and an anode of the light emitting element is connected to a second node, and a cathode of the light emitting element is grounded;

the first data input module comprises a first transistor and a first storage capacitor; a first pole of the first transistor is connected to the first node, a second pole of the first transistor is connected to the first data signal, and a gate of the first transistor is connected to a first scan signal; a first storage capacitor, one end of the first storage capacitor is connected to the first node, and another end of the first storage capacitor is directly grounded;

the second data input module comprises a second transistor and a second storage capacitor, a first pole of the second transistor is connected to a third node, a second pole of the second transistor is connected to the second data signal, and a gate of the second transistor is connected to a second scan signal; one end of the second storage capacitor is connected to the third node, and the other end of the second storage capacitor is connected to the first node;

the driving method comprises within a display period of a frame image:

the first data input module couples the first data signal to the first node;

the second data input module couples the second data signal to the first node after the first data signal is coupled to the first node by the first data input module, so that a voltage at the first node becomes superposition of a voltage of the first data signal and a voltage of the second data signal;

the display driving module transmits the power signal to the second node;

the light emitting module generates a working current under the control of the power signal coupled to the second node and emit light according to the working current.

5. The driving method of claim 4, wherein the driving method comprises:

before the first preset time period, the first transistor is connected to the first high potential of the first scan signal, the first transistor is turned on, and within the first preset time period, the first data signal is coupled to the first node, and the voltage of the first node rises to a first threshold voltage.

6. The driving method of claim 5, wherein the driving method comprises:

within a second preset time period, the first scan signal is at a low potential, the second scan signal is at a high potential, the first transistor is turned off, the second transistor is turned on, and the second data signal is coupled to the third node, and coupled to the first node through the second storage capacitor, and the voltage of the first node rises from the first threshold voltage to a third threshold voltage.

7. The driving method of claim 6, wherein the driving method comprises:

within the first preset time period, when the voltage of the first node rises to the first threshold voltage, the driving transistor is turned on, and the voltage of the second node rises to a second threshold voltage, so the current of the light-emitting element rises to a first threshold current, and the second threshold voltage is positively related to the first threshold voltage and the voltage of the power supply signal;

within the second preset time period, when the voltage of the first node rises to the third threshold voltage, the driving transistor continues to be turned on, and the voltage of the second node rises to a fourth threshold voltage, the fourth threshold voltage is positively correlated with the second threshold voltage and the power signal, and the current of the light emitting element increases to a second threshold current, which causes the light emitting element to emit light.

8. A display panel, comprising a pixel driving circuit, wherein the pixel driving circuit comprises a first data input module, a second data input module, a display driving module and a light emitting module;

the first data input module is configured to couple a first data signal to a first node;

the second data input module is configured to couple a second data signal to the first node after the first data signal is coupled to the first node by the first data input module, so that a voltage at the first node becomes superposition of a voltage of the first data signal and a voltage of the second data signal;

the display driving module comprises a driving transistor, and the driving transistor is controlled by a potential generated at the first node when the first data signal and the second data signal are coupled to the first node, and is used to transmit a power signal to a second node;

the light emitting module comprises a light emitting element, and an anode of the light emitting element is connected to the second node, and a cathode of the light emitting element is grounded, and the light emitting module is configured to generate a working current under the control of the power signal coupled to the second node and emit light according to the working current;

the first data input module comprises a first transistor and a first storage capacitor; a first pole of the first transistor is connected to the first node, a second pole of the first transistor is connected to the first data signal, and a gate of the first transistor is connected to a first scan signal; a first storage capacitor, one end of the first storage capacitor is connected to the first node, and another end of the first storage capacitor is directly grounded; and the second data input module comprises a second transistor and a second storage capacitor, a first pole of the second transistor is connected to a third node, a second pole of the second transistor is connected to the second data signal, and a gate of the second transistor is connected to a second scan signal; one end of the second storage capacitor is connected to the third node, and the other end of the second storage capacitor is connected to the first node.

9. The display panel of claim 8, wherein the driving transistor, the first transistor, and the second transistor are all N-type transistors, or the driving transistor, the first transistor, and the second transistor are all P-type transistors.

* * * * *